US006167572B1

(12) United States Patent
Naumovitz

(10) Patent No.: US 6,167,572 B1
(45) Date of Patent: Jan. 2, 2001

(54) REINFORCED GARMENT WITH LOOPED GRASPING HANDLES

(76) Inventor: Gary Naumovitz, Rd. 4 Box 148BB, Ellsworth, ME (US) 04605

( * ) Notice: Under 35 U.S.C. 154(b), the term of this patent shall be extended for 0 days.

(21) Appl. No.: 09/428,168

(22) Filed: Oct. 27, 1999

(51) Int. Cl.[7] ..... A41D 1/06
(52) U.S. Cl. ..... 2/227; 2/300
(58) Field of Search ..... 2/227, 243.1, 305, 2/23, 70, 22, 79, 69, 458, 457, 81, 456, 240, 228, 229, 300

(56) References Cited

U.S. PATENT DOCUMENTS 2,563,766 * 8/1951 Weinstein et al. ..... 227/49
3,533,107 * 10/1970 Raneri et al. ..... 2/93
3,562,812 * 2/1971 Greggains ..... 2/94
4,028,742 * 6/1977 Marquis ..... 2/305
4,411,222 * 10/1983 Wolfson ..... 119/96
4,449,253 * 5/1984 Hettinger ..... 2/93
4,599,750 * 7/1986 Rahaman ..... 2/243
5,369,804 * 12/1994 Metcalf ..... 2/69

* cited by examiner

*Primary Examiner*—John J. Calvert
*Assistant Examiner*—Alissa L. Hoey
(74) *Attorney, Agent, or Firm*—Michael I Kroll

(57) ABSTRACT

The present invention 10 discloses a pants garment 16 for use by both men 12 and women 14 having a pair of grasping handles 18 attached to the sides of the garment 16 in the area of sides of the hips of the user. The handles 18 are reinforceably attached to the garment 16 so that the handles 18 can be forceably grasped by a user without tearing loose. The handles 18 are attached by rivets 48 to a frame member 20 which is sewn by stitching 50 into the sides of the garment 16 so that the handles 18 are reinforceably attached to the garment 16.

8 Claims, 6 Drawing Sheets

REINFORCED GARMENT WITH LOOPED GRASPING HANDLES

BACKGROUND OF THE INVENTION

1. Field of the Invention

The present invention relates generally to clothing and, more specifically, to a reinforced garment with looped grasping handles that are attached to an infrastructure that is integral to the garment leaving the handles accessible so a person wearing the garment while dancing could be securely held, twirled and caught by a partner using the grasping handles. The grasping handles are formed by a rigid material, preferably leather, stiff rope or lightweight metal such as aluminum. The infrastructure comprises a support frame and a securing pocket to attach the frame to the garment. The support frame is a flat, belt-like loop that encircles the waist area of the garment with an exposed end on either side of the front fly area that snap together to secure the loop. Handle attachment tabs extend substantially from the belt portion of the support frame down along the garment's outer seams. The support frame is made from a sturdy material, preferably a lightweight, pliable metal or leather. The material of the securing pocket is the same as that of the garment.

2. Description of the Prior Art

There are other handle devices designed for clothing. Typical of these is U.S. Pat. No. Des. 408,967 issued to Wayne C. Van Hoesen on May 7, 1999.

Another patent was issued to Dennis Landreth et al. on Oct. 27, 1987, as U.S. Pat. No. Des. 292,440. Yet another U.S. Pat. No. 3,014,219 was issued to D. T. Corbett on Dec. 26, 1961 and still yet another was issued on Oct. 18, 1930 to H. C. Dauphinais as U.S. Pat. No. 1,883,341.

U.S. Pat. No. Des. 408,967

Inventor: Wayne C. Van Hosen

Issued: May 4, 1999

This United States patent discloses the ornamental design or a pocket guard for jeans as illustrated in the drawings of the patent.

U.S. Pat. No. Des. 292,440

Inventor: Dennis Landreth

Issued: Oct. 27, 1987

This United States patent discloses the ornamental design for hand loop for jeans as illustrated in the drawings of the patent.

U.S. Pat. No. 3,014,219

Inventor: Donald T. Corbett

Issued: Dec. 26, 1961

This United States patent discloses a football jersey adapted to be worn by an athlete when engaged in contest play and having a closely-embracing body portion adapted to extend from the neckline to below the waistline, said body portion having a front panel, a pair of vertically-arranged laterally-spaced handhold straps positioned on said front panel on each side thereof and having their upper and lower ends secured to said panel, said straps being of a length to extend to upper chest-covering portion of said front panel to a point adjacent the waistline of said front panel and being adapted to support the arms from the body of an athlete when wearing said jersey and engaged in contest play.

U.S. Pat. No. 1,883,341

Inventor: H. C. Dauphinais

Issued: Oct. 18, 1932

This United States patent discloses an improved device to support the leg portions of underwear drawers, and to prevent pulling and binding of the drawers about the crotch, comprising a pair of fabric straps secured at their lower ends to the front leg portions of the drawers intermediate a vertical line taken through the crotch and the outer side edges of the drawers and the adjustable securing means carried by said straps adjacent their upper ends of the straps to a garment worn about the waist of the wearer.

While these handle devices designed for clothing may be suitable for the purposes for which they were designed, they would not be as suitable for the purposes of the present invention, as hereinafter described.

SUMMARY OF THE PRESENT INVENTION

The present invention discloses a pants garment for use by both men and women having a pair of grasping handles attached to the sides of the garment in the area of sides of the hips of the user. The handles are reinforceably attached to the garment so that the handles can be forceably grasped by a user without tearing loose. The handles are attached by rivets to a frame member which is sewn by stitching into the sides of the garment so that the handles are reinforceably attached to the garment.

A primary object of the present invention is to provide a reinforced garment that has looped grasping handles that can be held by the wearer's partner or partners while dancing instead of holding their waist. The grasping handles aid in holding, twirling, or catching someone wearing the present invention or for a new design.

A further object of the present invention is to provide a garment with looped, leather grasping handles that are fastened to a lightweight, pliable metal framework that is attached to an interior portion of the garment. The support frame runs around the waistline and extends down vertically along the outer seams. The looped grasping handles are riveted to the vertical attachment tabs of the support frame through the garment material to reinforce the handle connection points in order to prevent tearing the garment material when under stress and to provide stability when steering a partner while dancing.

Still yet another object of the present invention is to provide a garment with looped grasping handles whereby each handle will comprise a strap of leather with opposing ends forming flat, elongated fastening sections and a rounded central portion to form a grasping handle when looped. Both fastening sections of each handle are to be permanently affixed to the exterior portion of the garment by rivets or other fasteners running through the garment and connected to the attachment tabs of the support frame.

An additional object of the present invention is to provide a garment with looped grasping handles wherein the portion of the support frame that encircles the waist area of the garment has two opposing ends which extend beyond the fly of the garment and snap together to secure the support frame to the wearer.

Another additional object of the present invention is to provide a garment with looped grasping handles having a support frame which is permanently affixed within a pocket in an interior portion of the garment.

Another object of the present invention is to provide a garment with looped grasping handles that can be held by partners while line-dancing.

Yet another object of the present invention is to provide a garment with looped grasping handles that can be held by the person wearing the garment while dancing. The user could hook his or her thumbs in the grasping handles rather than in belt loops.

Yet another object of the present invention is to provide a garment with looped grasping handles that, when worn by a person operating a motorcycle, would allow a passenger to safely and securely hold onto the operator.

Yet another object of the present invention is to provide a garment with looped grasping handles that would enable the user to pull on a pair of tight jeans without tearing the belt loop.

Still another object of the present invention is to provide a garment with looped grasping handles wherein the handles are ornamental and can vary in shape, design, or material to allow for many styles.

Additional objects of the present invention will appear as the description proceeds.

The present invention overcomes the shortcomings of the prior art by providing a garment with looped grasping handles that are permanently fastened to a metallic support frame integrated within the garment. The grasping handles could be used for dancing, to provide handholds for a motorcycle passenger, or to pull on a tight garment.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
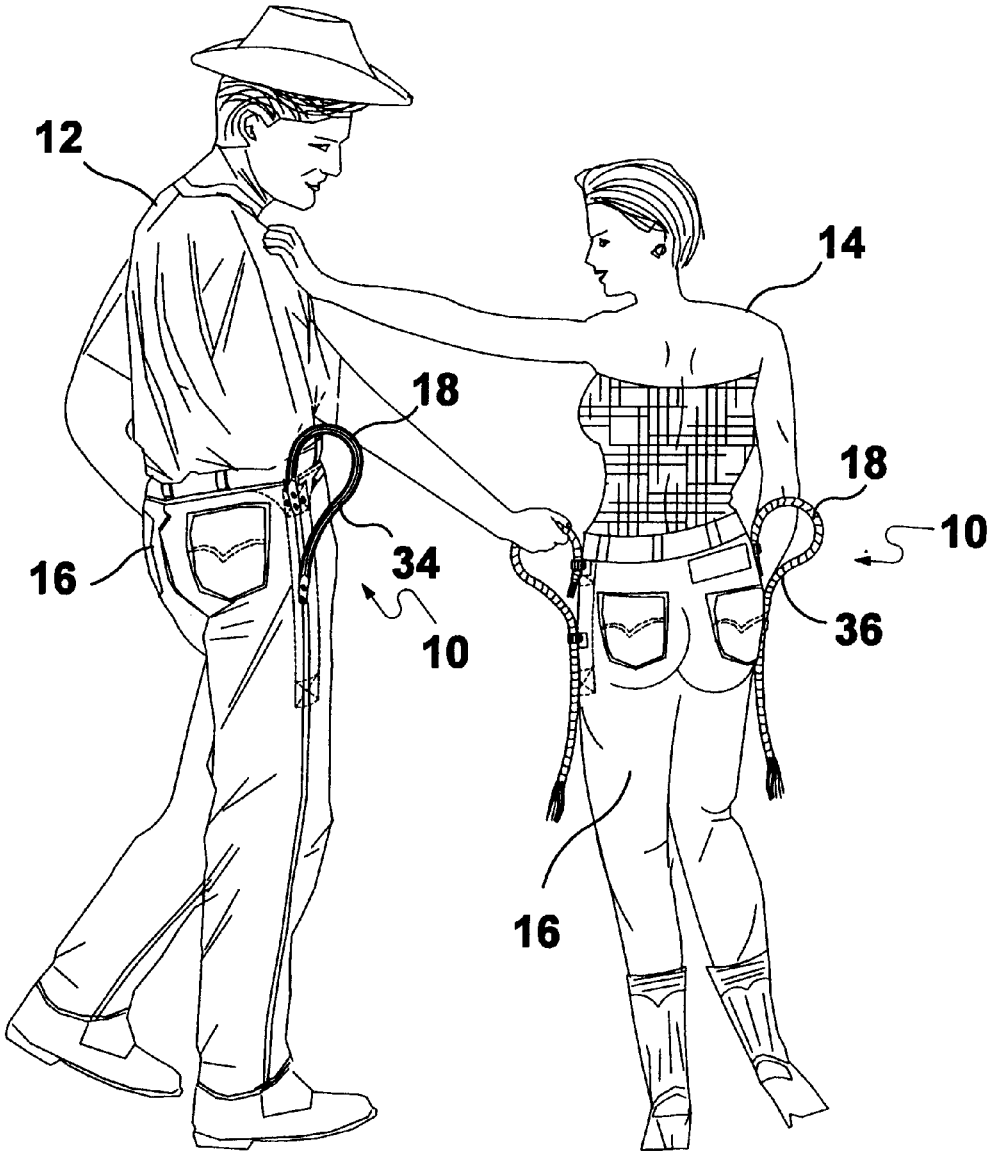
FIG. 1 is an illustrated view of the present invention in use. Shown is a male and a female dancing with one another and each is wearing a garment that has straps forming grasping handles that are attached to a support frame sewn into the interior portion of the trousers. The support frame is a flat, narrow band of metallic material within the circumference of the waistband with two appendages extending down the sides towards the knee forming attachment tabs. The attachment tabs are sandwiched between the garment and a precut material similar the garment that are sewn together to form a pocket providing a means for securing the support frame to the garment. The grasping handles on the garment worn by the male are made of smooth rolled leather while the garment worn by the female shows an alternate feature utilizing stiff, heavy-gauge rope to form the grasping handles.

With regard to reference numerals used, the following numbering is used throughout

10 present invention
12 male
14 female
16 garment
18 handles
20 frame

22 waistband
24 appendages
25 appendages
26 knee
28 attachment tabs
30 precut material
32 pocket
34 leather
36 rope
38 person
40 motorcycle
42 passenger
44 ends
46 round portion
48 rivets
50 stitching
52 belt loops
54 fastening surface
56 cross-stitching
58 apertures
60 exposed ends
62 snap means

DESCRIPTION OF THE PREFERRED EMBODIMENT(S)

In order that the invention may be more fully understood, it will now be described, by way of example, with reference to the accompanying drawings in which FIGS. 1 through 6 illustrate the present invention being a reinforced garment having grasping handles thereon.

Turning to FIG. 1, therein is shown is an illustrated view of the present invention 10 in use. Shown is a male 12 and a female 14 dancing with one another and each is wearing a trouser-like garment 16 that has straps forming grasping handles 18 in the area of the hips of the user that are attached to a support frame (not shown, but see FIG. 6) sewn into the interior portion of the garment trousers 16.

Figure 6:
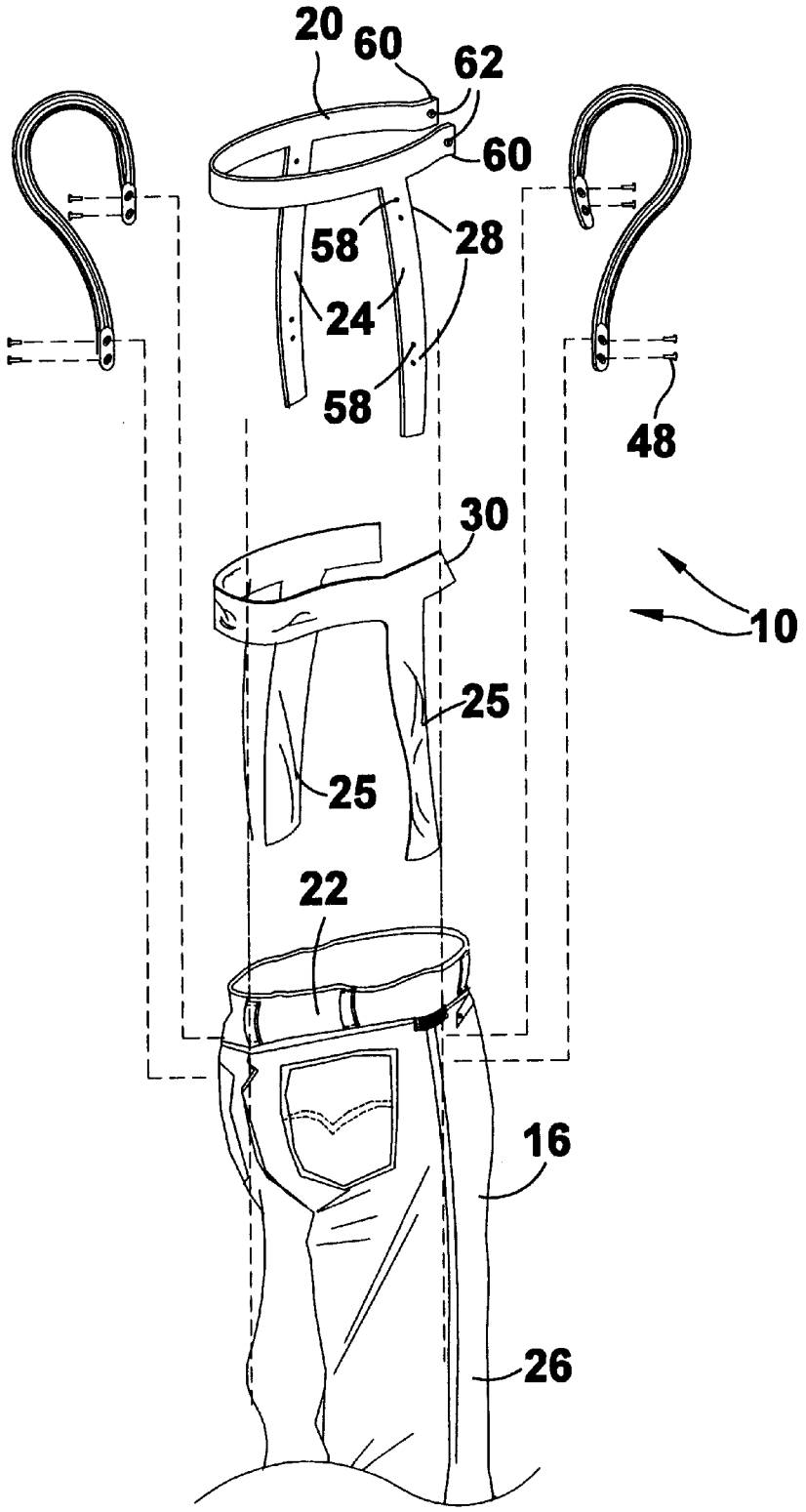
FIG. 6 is an exploded view of the present invention: shown is a garment portion, a metallic support frame, pre-cut material for the support frame retaining pocket, rivets to provide a means for fastening the handles and two grasping handles.

Turning temporarily to FIG. 6, the support frame 20 is a flat, narrow band of metallic material within the circumference of the waistband 22 with two elongated appendages 24 extending down the interior of the sides of the outer seam or perimeter of the trousers 16 towards the knee 26 having multiple attachment points or tabs 28 thereon. The appendages 24, having apertures 58 therein, are sandwiched between the garment 16 and a precut material 30 having precut downwardly extending elongated appendages 25 similar to the garment 16 that are sewn together to form a pocket (not shown) on the interior of trousers 16 having support frame 20 interior thereto and providing a means for securing the support frame 20 to the garment 16.

Returning to FIG. 1, the grasping handles 18 on the garment 16 worn by the male 12 are made of smooth rolled leather 34 while the garment 16 worn by the female 14 shows an alternate feature utilizing stiff, heavy-gauge rope 36 to form the grasping handles 18.

Figure 2:
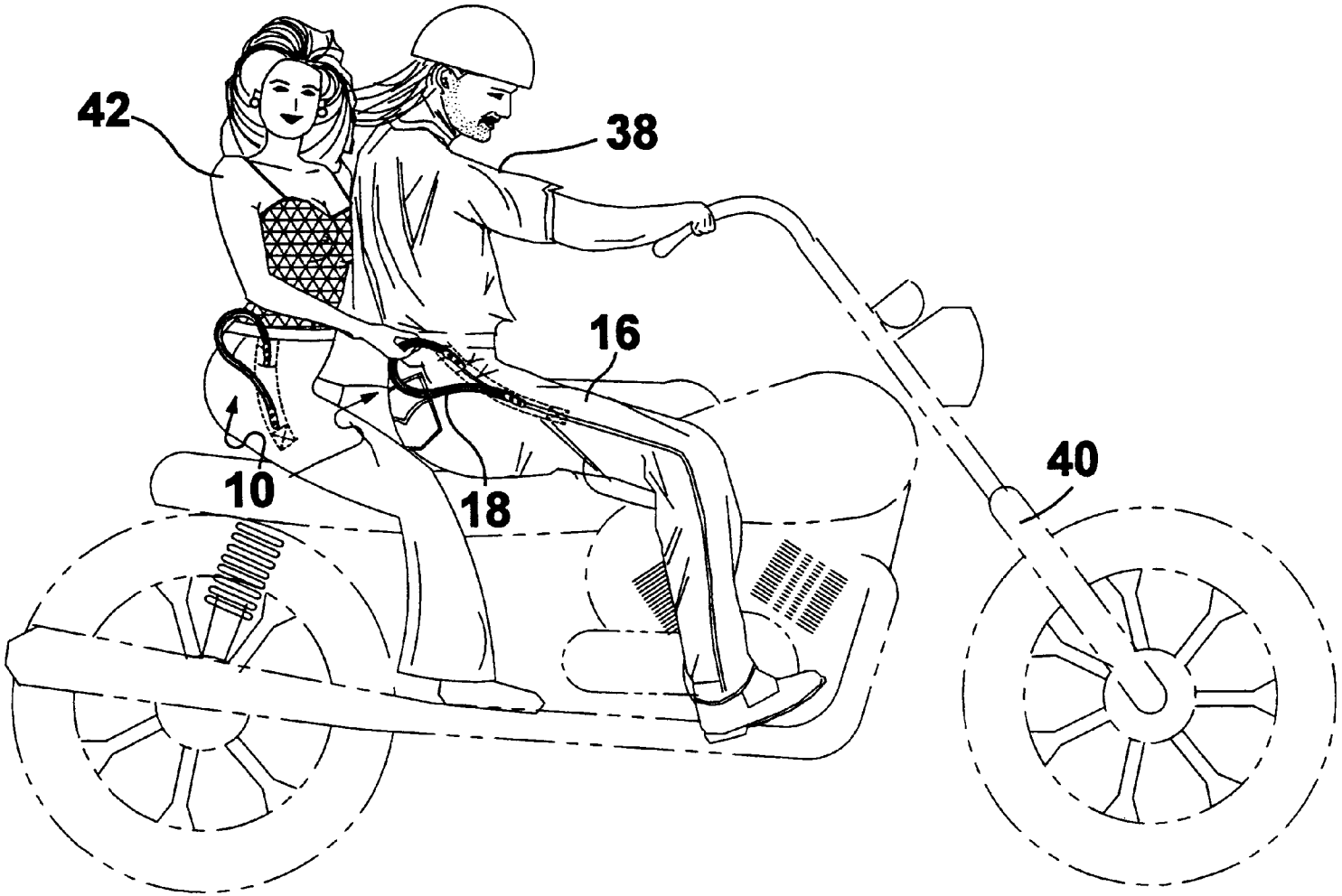
FIG. 2 is an illustrated view of the present invention in use; shown is a person wearing a garment with looped grasping handles operating a motorcycle and a passenger holding onto the grasping handles. The garment has straps forming grasping handles that are attached to a support frame sewn into the interior portion of the trousers. The support frame is a flat, narrow band of metallic material within the circumference of the waistband with two appendages extending down the sides towards the knee forming attachment tabs. The attachment tabs are sandwiched between the garment and a precut material similar the garment that are sewn together to form a pocket providing a means for securing the support frame to the garment. The garment with looped grasping handles provides the passenger with a safe and secure means for holding onto the driver without hindering his ability to operate the vehicle.

Turning to FIG. 2, shown therein is an illustrated view of the present invention 10 in use. Shown is a person 38 wearing a garment 16 equipped with looped grasping handles 18 operating a motorcycle 40 and a passenger 42 holding onto the grasping handles 18 of the operator 38. The garment 16 has straps forming grasping handles 18 that are attached to the trousers 16. The garment 16 with looped grasping handles 18 provides the passenger 42 with a safe and secure means for holding onto the operator 38 without hindering the operator's ability to operate the vehicle 40.

Figure 3:
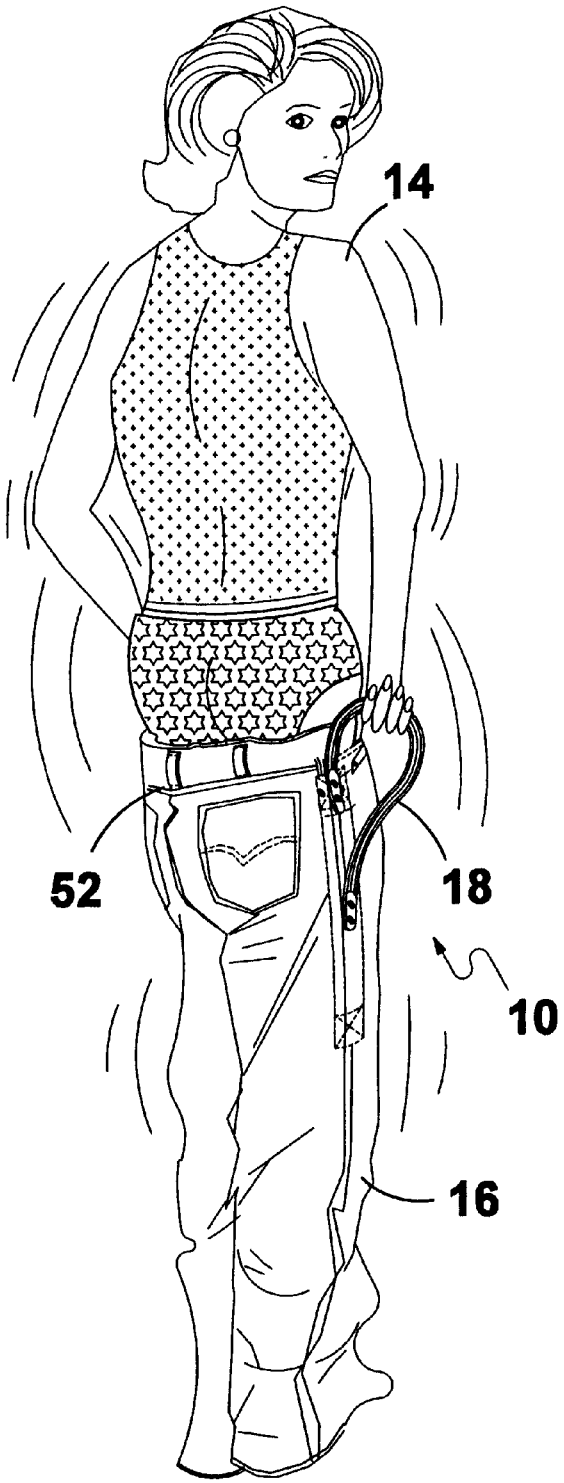
FIG. 3 is an illustrated view of the present invention in use, shown is a woman pulling on a tight garment with looped grasping handles. The grasping handles provide a more secure means for pulling on a tight pair of jeans than using belt loops which tend to tear when under stress. The garment has straps forming grasping handles that are attached to a support frame sewn into the interior portion of the trousers. The support frame is a flat, narrow band of metallic material within the circumference of the waistband with two appendages extending down the sides towards the knee forming attachment tabs. The attachment tabs are sandwiched between the garment and a precut material similar the garment that are sewn together to form a pocket providing a means for securing the support frame to the garment.

Turning to FIG. 3, shown therein is an illustrated view of the present invention 10 in use. Shown is a woman 14 pulling on a tight garment 16 with looped grasping handles 18. The grasping handles 18 provide a more secure means for pulling on a tight pair of jeans 16 than using belt loops 52 which tend to tear when under stress. The garment 16 has straps forming grasping handles 18 that are attached to the trouser 16.

Figure 4:
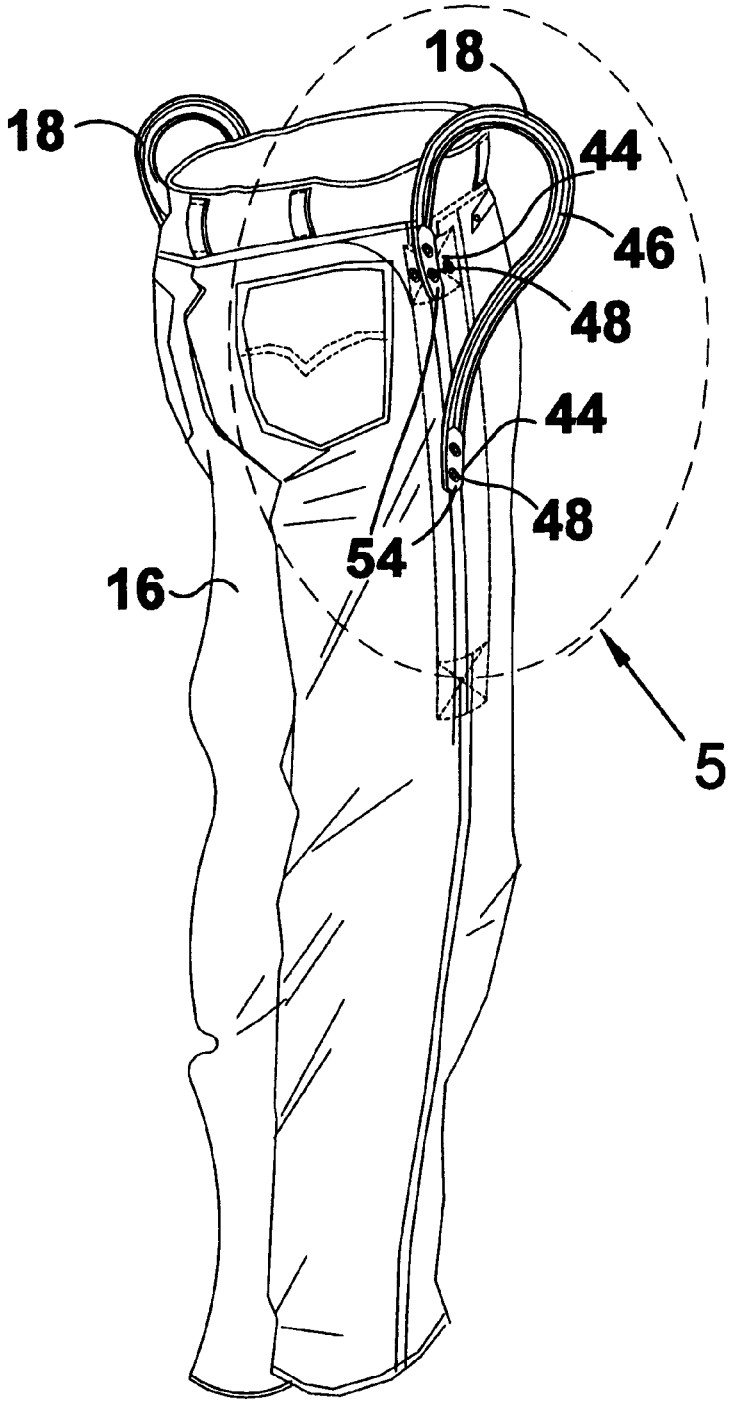
FIG. 4 is a perspective view of a garment with looped grasping handles comprising a pair of blue jeans with leather straps or lightweight smooth metal forming a grasping handle on either side. Each leather strap has two opposing ends with flat fastening sections connected by a thick, rounded central portion that provides the grasping handles when the fastening sections are permanently affixed with rivets to the attachment tabs of a pliable, lightweight metal support frame sewn into the garment.

Turning to FIG. 4, shown therein is a perspective view of a garment 16 with looped grasping handles 18 comprising a pair of blue jeans with leather straps or lightweight smooth metal forming a grasping handle 18 on either side. Each leather strap has two opposing ends 44 with flat fastening surfaces 54 connected by a thick, rounded central portion 46 that provides the grasping handles 18. The fastening surfaces 54 are permanently affixed with rivets 48 or the like to the garment 16.

Figure 5:
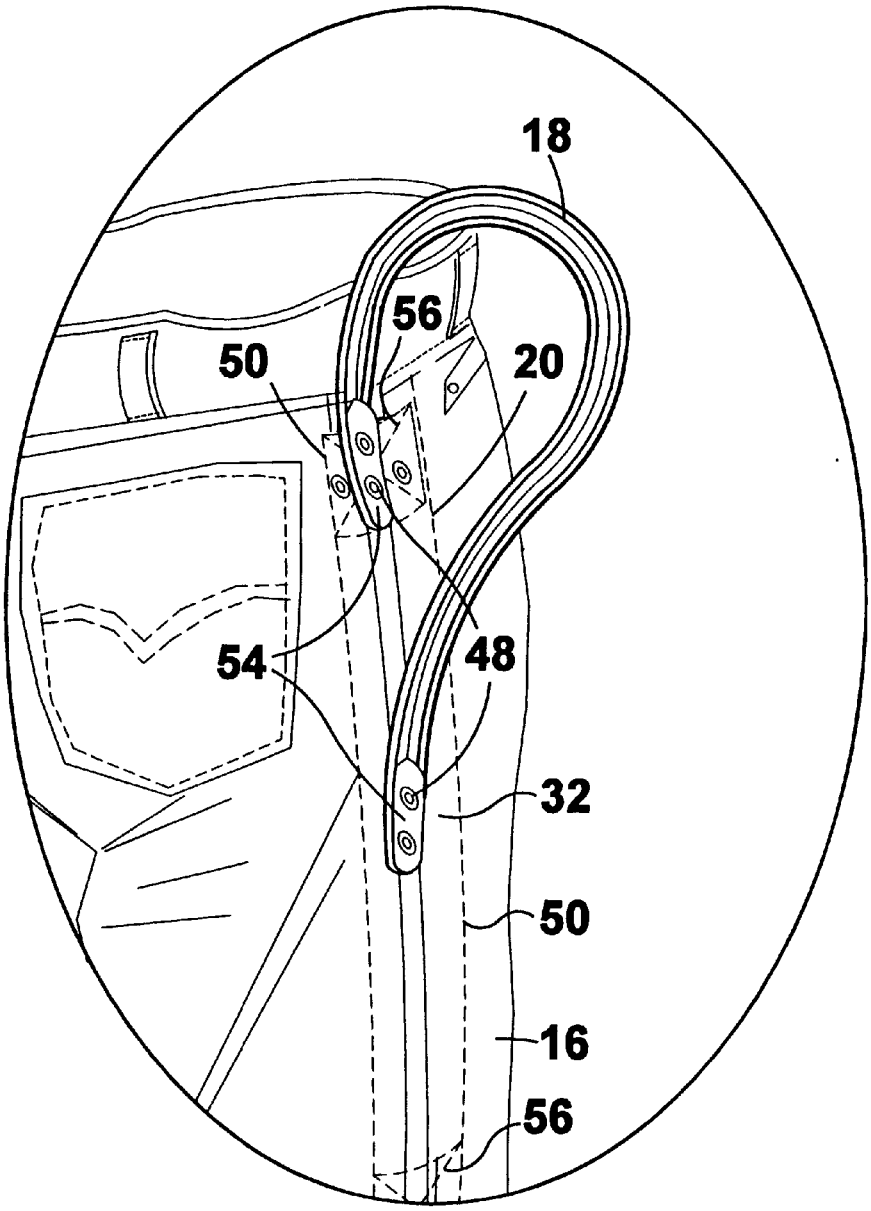
FIG. 5 is a detailed view of the handle taken from FIG. 4 as indicated. Shown is the stitching of the support frame sewn into a pocket on an interior portion of the garment. The fastening sections are secured to the attachment tabs of the support frame with rivets. The support frame provides stability and reinforces the attachment points to prevent tearing when under stress.

Turning to FIG. 5, shown therein is a detailed view of the handle 18 taken from FIG. 4 as indicated. Shown is the stitching 50 with extra cross-stitching 56 on the ends of the support frame 20 sewn into a pocket 32 on an interior portion of the garment 16. The fastening surfaces 54 are secured to the attachment tabs (not visible) of the support frame 20 with rivets 48. The support frame 20 provides stability and reinforces the attachment points to prevent tearing when under stress.

Turning to FIG. 6, shown therein is an exploded view of the present invention 10. Shown is a garment portion 16, a metallic support frame 20, pre-cut material 30 for the support frame retaining pocket, and multiple rivets 48 to provide a means for fastening the two grasping handles 18 to the support frame 20 which rivets are received by multiple apertures 58. The support frame 20 is a flat, belt-like member which encircles the waist of the user coincident with and interior to the waistband 22 of the trousers 16 having a pair of exposed ends 60 on either side of the front fly area having mating snap means 62 for securing the belt-like member 20 around the user.

What is claimed to be new and desired to be protected by Letters Patent is set forth in the appended claims:

1. An apparatus for providing a pair of handles for use on the exterior of conventional trouser-like garments, comprising:

a) a pair of elongated handle members each having a first end and a second end sized for use on human trousers;

b) reinforcement means disposed in the interior of the trousers;

c) means for attaching said elongated members to said reinforcement means of the trousers, said first and second ends of said elongated handle members being flattened near the ends of said elongated members whereby said ends can be fastened to the trousers;

d) one of said pair of elongated handle members being disposed on a first side of said trousers and a second side of said trousers, in the area of the hips of the human; and e) said flattened ends of said elongated handle members having a plurality of apertures therein for receiving fasteners for fastening said elongated handle members to said trousers.

2. The apparatus of claim 1, wherein said elongated handle members are made of rope.

3. The apparatus of claim 1, wherein said elongated handle members are made of leather.

4. The apparatus of claim 1, wherein said elongated handle members are made of metal.

5. An apparatus for providing a pair of handles for use on the exterior of conventional trouser-like garments, comprising:

a) a pair of elongated handle members sized for use on human trousers;

b) reinforcement means disposed in the interior of the trousers;

c) means for attaching said elongated members to said reinforcement means of the trousers;

d) said reinforcement means further comprising a metal support frame disposed on the inside of the waistband of the trousers, said support frame encircling the user; and e) said support frame further comprising a pair of downwardly extending elongated appendages, said support frame and said elongated appendages providing means for securement of said elongated handle members to the interior of the trousers disposed on the outside of the legs of the trousers near the hips of the user.

6. The apparatus of claim 5, said means for securement further comprise a backing cloth member for being sewn onto the interior of the trouser legs, said backing cloth member forming a pocket about said support frame whereby said support frame is fixedly attached to the inside of the trousers.

7. The apparatus of claim 5, wherein said support frame is made of fiberglass.

8. The apparatus of claim 5, said support frame further comprising exposed ends, said exposed ends having mating snap means thereon whereby said support means is fastened about the waist of the user.

* * * * *